US007105067B2

(12) United States Patent
Sankaran et al.

(10) Patent No.: US 7,105,067 B2
(45) Date of Patent: Sep. 12, 2006

(54) METHOD TO INCREASE THE TOUGHNESS OF ALUMINUM-LITHIUM ALLOYS AT CRYOGENIC TEMPERATURES

(75) Inventors: Krishnan K. Sankaran, St. Louis, MO (US); Brian J. Sova, St. Charles, MO (US); Henry W. Babel, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 413 days.

(21) Appl. No.: 10/456,385

(22) Filed: Jun. 5, 2003

(65) Prior Publication Data

US 2005/0284552 A1 Dec. 29, 2005

(51) Int. Cl.
*C22C 21/00* (2006.01)

(52) U.S. Cl. ..... 148/698; 148/697; 148/694

(58) Field of Classification Search ..... 148/698, 148/700, 697, 690, 693, 694, 699
See application file for complete search history.

(56) References Cited

U.S. PATENT DOCUMENTS

| | | | |
|---|---|---|---|
| 4,294,625 | A | 10/1981 | Hyatt et al. |
| 4,305,763 | A | 12/1981 | Quist et al. |
| 4,336,075 | A | 6/1982 | Quist et al. |
| 4,603,029 | A | 7/1986 | Quist et al. |
| 4,648,913 | A | 3/1987 | Hunt, Jr. et al. |
| 4,735,774 | A | 4/1988 | Narayanan et al. |
| 4,812,178 | A | 3/1989 | Dubost |
| 4,840,682 | A | 6/1989 | Curtis et al. |
| 4,861,391 | A | 8/1989 | Rioja et al. |
| 4,999,061 | A | 3/1991 | Curtis et al. |
| 5,116,572 | A | 5/1992 | Narayanan et al. |
| 5,133,930 | A | 7/1992 | Narayanan et al. |
| 5,160,555 | A | 11/1992 | Narayanan et al. |
| 6,869,490 | B1 * | 3/2005 | Cho ..... 148/698 |

OTHER PUBLICATIONS

"Alternate Heat Treatments of C458 Aluminum Lithium Alloy", Parrish et al, Materials Science Forum vols. 331-337 (2000) pp 655-662.*

* cited by examiner

*Primary Examiner*—Roy King
*Assistant Examiner*—Janelle Morillo
(74) *Attorney, Agent, or Firm*—Shimokaji & Associates, P.C.

(57) ABSTRACT

A method to increase the toughness of the aluminum-lithium alloy C458 and similar alloys at cryogenic temperatures above their room temperature toughness is provided. Increasing the cryogenic toughness of the aluminum-lithium alloy C458 allows the use of alloy C458 for cryogenic tanks, for example for launch vehicles in the aerospace industry. A two-step aging treatment for alloy C458 is provided. A specific set of times and temperatures to age the aluminum-lithium alloy C458 to T8 temper is disclosed that results in a higher toughness at cryogenic temperatures compared to room temperature. The disclosed two-step aging treatment for alloy 458 can be easily practiced in the manufacturing process, does not involve impractical heating rates or durations, and does not degrade other material properties.

28 Claims, 4 Drawing Sheets

METHOD TO INCREASE THE TOUGHNESS OF ALUMINUM-LITHIUM ALLOYS AT CRYOGENIC TEMPERATURES

STATEMENT REGARDING FEDERALLY SPONSORED RESEARCH OR DEVELOPMENT

This invention was made with Government support under contract number NAS8-01099 awarded by the National Aeronautics and Space Administration (NASA). The Government has certain rights in this invention.

BACKGROUND OF THE INVENTION

The present invention generally relates to aluminum-lithium alloys and methods for thermal treatment of aluminum-lithium alloys and, more particularly, to a method to increase the toughness of the aluminum-lithium alloy C458 at cryogenic temperatures.

Structural weight is a major issue for single use and reusable launch vehicles, for spacecraft, and other space vehicle structures used in the aerospace industry since weight reduction enables increased payload capability and reduced cost. It is well recognized that aluminum-lithium alloys possess lower density, good and often higher strength than conventional aluminum alloys, and provide higher modulus, and therefore, enable weight savings in space vehicle structures.

For the aerospace industry, the toughness of aluminum alloys and aluminum-lithium alloys at cryogenic temperatures is of special interest, for example, for the use of such materials in cryogenic tanks. Cryogenic tanks are used to hold liquid hydrogen, liquid oxygen, or any other liquid requiring cryogenic storage. Therefore, it is important for the alloy used in such tanks to have both a relatively high strength and high toughness at cryogenic service temperatures. Compared with conventional aluminum alloys such as 2219, which is widely used in space vehicles for cryogenic tanks as well as unpressurized structures, aluminum-lithium alloys possess an attractive combination of lower density and higher modulus along with higher mechanical properties than non-lithium containing aluminum alloys commonly used for cryogenic tanks. The toughness of conventional aluminum alloys such as 2219 and 2014 is higher at cryogenic temperatures compared to that at room temperature. The ability to achieve higher toughness and strength at cryogenic temperatures enables a structural proof test for the cryotank, for example, to be conducted more inexpensively at room temperature than at cryogenic temperatures. In this case a successful room temperature proof test ensures that neither strength-overload-induced nor toughness-limited-induced failure will occur at cryogenic service temperatures. The toughness of aluminum-lithium alloys at cryogenic temperatures often remains the same as the toughness at room temperature or is reduced when the material is processed and heat treated using conventional single-step aging. If the toughness of an aluminum-lithium alloy is lower at cryogenic temperatures, the performance of acceptance testing at the cryogenic temperature has to be considered, which is a very expensive and involved approach.

A prior art aluminum-lithium alloy 2195 (Al-1.0 Li-4.0 Cu-0.4 Mg-0.4 Ag-0.12 Zr) with a low lithium content of nominally 1.0 wt. % has already been successfully used for the Space Shuttle external tank. As is well known, alloy processing and particularly the aging treatment, has a significant influence on the strength-toughness combinations and their dependence on the service environments for all aluminum-lithium alloys. A prior art two-step aging procedure developed for the aluminum-lithium alloy 2195 showed that the cryogenic toughness was improved when a low-temperature aging step was followed by a higher-temperature aging step. The purpose of the initial low-temperature aging is to provide nucleation sites within the matrix and to minimize the volume fraction of the strengthening precipitates at the sub-grain and grain boundaries, while the second step is necessary to increase the size of the precipitates to provide reasonable strength levels. These prior art heat treatment methods to improve the cryogenic toughness of the aluminum-lithium alloys were limited to the alloy 2195 and entailed processing conditions such as controlled heating rates or durations that may not be practical in the industry.

While a higher lithium content in aluminum-lithium alloys results in more weight savings, an aluminum-lithium alloy C458 (Al-1.8 Li-2.7 Cu-0.3 Mg-0.08 Zr-0.3 Mn-0.6 Zn) with a lithium content of nominally 1.8 wt. % and similar alloys from this family of alloys, such as C460 and C47A, have been shown to provide the greatest benefit for the aerospace industry. The composition and processing of alloy C458 and similar alloys in this family has been carefully tailored to increase the toughness and reduce the mechanical property anisotropy of the earlier generation alloys such as 2090 and 8090, which have a lithium content above 2.0 wt. %. Therefore, aluminum-lithium alloy C458 is considered as a material to be used for future space vehicle structures. To achieve the T8 temper material characteristics, alloy C458 in the T3 condition (achieved by solution heat treatment at an elevated temperature, quenching to room temperature and cold working, for example by stretching) is typically aged at 300° F. for a duration of twenty-four hours using conventional single-step aging. This prior art single-step aging process applied to alloy C458 results in a reduction of the toughness at cryogenic temperatures over that at room temperature of about 10%. Consequently, if the aluminum-lithium alloy C458 were to be used to build a cryogenic tank after the single step aging was conducted, expensive structural proof testing of the tank at cryogenic temperatures would be necessary to ensure proper strength and toughness parameters.

Prior art further includes, for example, U.S. Pat. No. 4,861,391 issued to Rioja et al., U.S. Pat. No. 4,812,178 issued to Dubost, and U.S. Pat. No. 4,648,913 issued to Hunt, Jr. et al., all disclosing aluminum based alloys containing lithium as well as heat treatment methods. U.S. Pat. No. 4,861,391 issued to Rioja et al. further discloses a two-step aging method for aluminum-based alloys; however the first aging step conducted at lower temperatures can take up to several months, which is inconvenient and expensive. Since a heat treatment process needs to be optimized for each alloy individually depending on the content of chemical elements in this alloy, none of the disclosed prior art heat treatments can be easily applied to the processing of the aluminum-lithium alloy C458. Further, none of the prior art patents recommends the disclosed aging procedures for application on alloy C458 or similar alloys.

There has, therefore, arisen a need to increase the toughness at cryogenic temperatures of the aluminum-lithium alloy C458 to enable its use for cryogenic tanks in space vehicles, and thereby, reducing the weight of the cryogenic tanks, increasing the payload capabilities, and reducing cost per launch. There has further arisen a need for the development of a heat treatment scheme for aluminum-lithium alloy C458 and similar alloys of this family that results in an increased toughness of the alloy C458 at cryogenic temperatures compared to room temperature. There has also arisen a need to develop a method for an aging treatment for alloy C458 that can be easily practiced in the manufacturing process, that does not involve impractical heating rates or durations, and that does not degrade other material properties. There has further arisen a need to provide specific sets of times and temperatures to age the aluminum-lithium alloy C458 to the T8 temper that result in higher toughness at cryogenic temperatures compared to room temperature, so that an optimized aging cycle can be selected during the manufacturing process.

As can be seen, there is a need for a method to increase the toughness of aluminum-lithium alloy C458 at cryogenic temperatures. Also, there is a need for an aging treatment for alloy C458 that increases the toughness at cryogenic temperatures and that can be easily practiced in the manufacturing process. Moreover, there is a need for specific sets of times and temperatures to age aluminum-lithium alloy C458 to the T8 temper that result in higher cryogenic toughness.

SUMMARY OF THE INVENTION

The present invention provides a method to increase the toughness of the aluminum-lithium alloy C458 and similar alloys at cryogenic temperatures above their room temperature toughness, thereby enabling the economic use of alloy C458 for cryogenic tanks, for example for launch vehicles in the aerospace industry, without need for expensive proof testing at a cryogenic temperature. The present invention also provides a method for an aging treatment for alloy C458 that can be easily practiced in the manufacturing process, that does not involve impractical heating rates or durations, and that does not degrade other material properties. The present invention further provides specific sets of times and temperatures to age the aluminum-lithium alloy C458 to the T8 temper that result in higher toughness at cryogenic temperatures compared to room temperature, such that an optimized aging cycle can be selected during the manufacturing process.

In one aspect of the present invention, a method for an aging treatment for aluminum-lithium alloy C458 comprises the steps of: providing an aluminum-lithium alloy C458 in the T3 condition, and conducting a two-step aging treatment on the aluminum-lithium alloy C458. The two-step aging treatment includes the steps of: aging the aluminum-lithium alloy C458 in a first step aging treatment at a temperature of 205° F. for a duration of 48 hours and aging the aluminum-lithium alloy C458 in a second step aging treatment at a temperature of 300° F. for a duration of 24 hours. T8 temper material properties and an increased toughness at cryogenic temperatures compared to room temperature are provided.

In another aspect of the present invention, a method for an aging treatment for aluminum-lithium alloy C458 comprises the steps of: providing an aluminum-lithium alloy C458 in the T3 condition, and conducting a two-step aging treatment on the aluminum-lithium alloy C458. The two-step aging treatment includes the steps of: aging the aluminum-lithium alloy C458 in a first step aging treatment at a temperature of 175° F. for a duration of 192 hours and aging the aluminum-lithium alloy C458 in a second step aging treatment at a temperature of 275° F. for a duration of 96 hours. T8 temper material properties and an increased toughness at cryogenic temperatures compared to room temperature are provided.

In still another aspect of the present invention, a method to increase the toughness of the aluminum-lithium alloy C458 at cryogenic temperatures compared to room temperature comprises the steps of: providing an aluminum-lithium alloy C458 material; achieving T3 condition of the aluminum-lithium alloy C458 material; subjecting the C458 material to a first step aging treatment at a temperature of 175° F. for a duration of 192 hours; and subjecting the C458 material to a second step aging treatment at a temperature of 275° F. for a duration of 96 hours. The achievement of the T3 condition includes the steps of: applying a solution treatment in air at a nominal temperature of 1020° F. for a nominal duration of 30 minutes to the C458 material; quenching the C458 material in water at room temperature; and cold working the C458 material at room temperature. The first step aging treatment and the second step aging treatment of the C458 material provide T8 temper material properties and an increased toughness at cryogenic temperatures compared to room temperature.

In still another aspect of the present invention, a method to increase the toughness of the aluminum-lithium alloy C458 at cryogenic temperatures compared to room temperature comprises the steps of: providing an aluminum-lithium alloy C458 material; achieving T3 condition of the aluminum-lithium alloy C458 material; subjecting the C458 material to a first step aging treatment at a temperature of 205° F. for a duration of 48 hours; and subjecting the C458 material to a second step aging treatment at a temperature of 300° F. for a duration of 24 hours. The achievement of the T3 condition includes the steps of: applying a solution treatment in air at a nominal temperature of 1020° F. for a nominal duration of 30 minutes to the C458 material; quenching the C458 material in water at room temperature; and cold working the C458 material at room temperature. The first step aging treatment and the second step aging treatment of the C458 material provide T8 temper material properties and an increased toughness at cryogenic temperatures compared to room temperature.

In a further aspect of the present invention, a method to increase the toughness of the aluminum-lithium alloy C458 at cryogenic temperatures compared to room temperature comprises the steps of: providing an aluminum-lithium alloy C458 material, wherein the aluminum-lithium alloy C458 material is comprised of Al, 1.8 wt. % Li, 2.7 wt. % Cu, 0.3 wt. % Mg, 0.08 wt. % Zr, 0.3 wt. % Mn, and 0.6 wt. % Zn, and wherein the aluminum-lithium alloy C458 material is provided in a product form selected from plate, sheet, extrusion, and ring; achieving T3 condition of the aluminum-lithium alloy C458 material by: applying a solution treatment in air at a temperature of 1020° F. for a duration of 30 minutes to the C458 material; quenching the C458 material in water at room temperature; stretching or similarly cold working the C458 material to about 6% at room temperature, wherein the delay between the quenching and the stretching is less than 2 hours; maintaining the C458 material at room temperature for at least two days; subjecting the C458 material to a first step aging treatment at a temperature of 175° F. for a duration of 192 hours; and subjecting the C458 material to a second step aging treatment at a temperature of 275° F. for a duration of 96 hours. The first step aging treatment and the second step aging treatment of the C458 material provide T8 temper material properties and an increased toughness at cryogenic temperatures compared to room temperature.

In still a further aspect of the present invention, a method to increase the toughness of the aluminum-lithium alloy C458 at cryogenic temperatures compared to room temperature comprises the steps of: providing an aluminum-lithium alloy C458 material, wherein the aluminum-lithium alloy C458 material is comprised of Al, 1.8 wt. % Li, 2.7 wt. % Cu, 0.3 wt. % Mg, 0.08 wt. % Zr, 0.3 wt. % Mn, and 0.6 wt.

% Zn, and wherein the aluminum-lithium alloy C458 material is provided in a product form selected from plate, sheet, extrusion, and ring; achieving T3 condition of the aluminum-lithium alloy C458 material by: applying a solution treatment in air at a temperature of 1020° F. for a duration of 30 minutes to the C458 material; quenching the C458 material in water at room temperature; stretching or similarly cold working the C458 material to about 6% at room temperature, wherein the delay between the quenching and the stretching is less than 2 hours; maintaining the C458 material at room temperature for at least two days; subjecting the C458 material to a first step aging treatment at a temperature of 205° F. for a duration of 48 hours; and subjecting the C458 material to a second step aging treatment at a temperature of 300° F. for a duration of 24 hours. The first step aging treatment and the second step aging treatment of the C458 material provide T8 temper material properties and an increased toughness at cryogenic temperatures compared to room temperature.

These and other features, aspects and advantages of the present invention will become better understood with reference to the following drawings, description and claims.

DETAILED DESCRIPTION OF THE INVENTION

Figure 1:
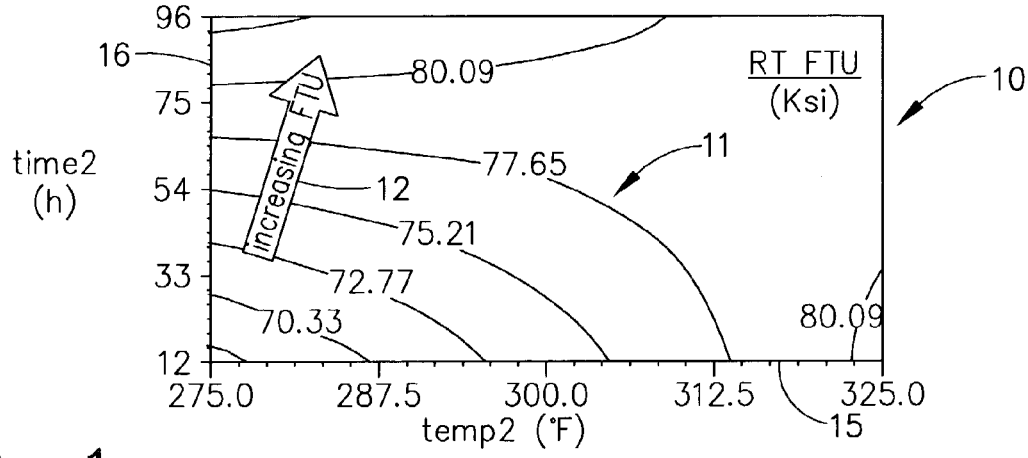
FIG. 1 is a contour plot illustrating the ultimate strength primarily dependent upon second step aging practice according to one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides a method to increase the toughness of aluminum-lithium alloy C458 and similar alloys of the same family, such as alloy C460 and C47A, at cryogenic temperatures compared to room temperature. An increased toughness at cryogenic temperatures of aluminum-lithium alloy C458 would allow the use of this alloy, for example, for cryogenic tanks for single use and reusable launch vehicles and other space vehicles in the aerospace industry, replacing materials, such as aluminum alloy 2219 or aluminum-lithium alloy 2195, that are currently used for cryogenic tanks in the aerospace industry. Replacement of prior art alloys, such as aluminum alloy 2219 or aluminum-lithium alloy 2195, by aluminum-lithium alloy C458, would result in weight reduction of the space vehicle, increased payload, and reduced cost per launch. The present invention further provides a method for an aging treatment for alloy C458 that increases the toughness of this alloy at cryogenic temperatures. The ability to achieve higher fracture toughness at cryogenic temperatures compared to room temperature enables the structural proof test for the tank to be conducted more inexpensively and more conveniently at room temperature.

In one embodiment, the present invention provides a two-step aging treatment that increases the toughness of aluminum-lithium alloy C458 at cryogenic temperatures by about 9% in comparison with its toughness at room temperature. In contrast, the conventional prior art aging conducted in a single step at one temperature (typically 300° F.) for a specific time (typically 24 hours) results in a reduction of the toughness at cryogenic temperatures of about 10% compared to room temperature. The two-step aging treatment of the present invention can be easily practiced in the manufacturing process, since it does not involve impractical heating rates or durations as some prior art two-step aging processes do. Further, the two-step aging treatment of the present invention does not degrade other material properties.

In one embodiment, the present invention provides a method for providing specific sets of times and temperatures to age aluminum-lithium alloy C458 to the T8 temper that result in higher toughness at cryogenic temperatures compared to room temperature. A range of time and temperature to optimize the strength and toughness combinations is provided. These data may be used for the development of a design database for use in production. No prior art data for aging processes for alloy C458 or similar alloys are known that lead to an increased toughness at cryogenic temperatures and that could easily be used in production. The data for the two-step aging treatment of the present invention may also be applicable to alloys with higher lithium content than 1.8 wt. % of alloy C458 (more weight savings).

By providing a method for two-step aging treatment for aluminum-lithium alloy C458 that increases the toughness of this alloy at cryogenic temperatures and that is easily practiced in manufacturing, the present invention enables the economic implementation and use of alloy C458, for example, in space vehicles for cryogenic tanks and therefore, reduces the weight of such space vehicle, which increases the payload capabilities and reduces the launch cost.

Referring now to Table 1, an aging optimization plan and aging treatment results for C458 plate samples are shown according to one embodiment of the present invention. A design of experiments aging study was conducted for aluminum-lithium alloy C458 (Al-1.8 Li-2.7 Cu-0.3 Mg-0.08 Zr-0.3 Mn-0.6 Zn) material in plate form. All plate samples P01–P17 and P20 were solution treated in air at 1020° F. for 30 minutes and quenched in water at room temperature. Further, the plate samples P01–P17 and P20 were cold worked, in this example by stretching 6% at room temperature. The delay between the quenching and stretching was less than 2 hours to avoid hardening of the material. The quenched and stretched samples were held at room temperature for a minimum of two days. After application of the described steps of solution treatment, quenching, and cold working by stretching, the plate samples of alloy C458 were in T3 condition. To achieve material properties according to T8 temper, alloy C458 in the T3 condition is typically aged in one step at 300° F. for 24 hours. In the design of experiments study that led to the present invention, a two-step aging treatment was developed and optimized through a comprehensive $2^4$ full factorial experiment with the typical single-step aging treatment data as reference. The $2^4$ factorial experiment consisted of $2^4$ (=16) conditions representing combinations of extreme values of the parameters (P01–P16) and one "center point" representing the mid-range of the parameters (P17). Plate sample P20 represented the baseline, single-step aging treatment. Plate samples P01–P17 and P20 were aged to the T8 temper using the parameters shown in Table 1.

As set forth in Table 1, plate samples P01–P17 all underwent a two-step aging treatment. A first step aging treatment was conducted at temperatures between 175° F. and 250° F. and with time variations between 12 hours and 192 hours to promote homogeneous nucleation of $T_1$ precipitate ($Al_2CuLi$) within the matrix, which improves the toughness at cryogenic temperature while it does not impact other properties. The temperature of 175° F. was the minimum considered necessary for $T_1$ nucleation whereas 250° F. was considered the maximum above which nucleation at grain boundaries would be easier. A second step aging treatment is necessary to obtain the optimum combination of strength and toughness within practical aging times. The second step aging treatment was conducted at temperatures between 275° F. and 325° F., which is in the range of the single-step aging temperature, and with time variations between 12 hours and 96 hours. The second step aging temperatures were selected to provide the balance between strength and toughness within practical aging times. The "center point" of the $2^4$ full factorial experiment representing the mid-range of the parameters was a two-step treatment including a first step aging treatment at 205° F. for 48 hours followed by a second step aging treatment at 300° F. for 24 hours (plate sample P17). The second-step parameters for the "center point" were also identical to that of the baseline, single-step aging condition (plate sample P20). Plate sample P20 was aged at 300° F. for 24 hours, which represents the optimized, single-step T8 temper aging treatment for the alloy C458 recommended by Alcoa.

As presented in Table 1, tensile properties were determined for plate samples P01–P17 and P20, and toughness properties were determined for selected samples showing adequate tensile properties. Tensile tests were conducted per ASTM E8 "Standard Test Methods for Tension Testing of Metallic Materials" and toughness tests were conducted per ASTM E 1820 "Standard Test Method for Measurement of Fracture Toughness". Three tensile tests and two toughness tests were conducted for each selected condition. A summary of the test results is given in Table 1. The first column from the left indicates the plate sample number, wherein plate samples P01–P17 were selected for the design of experiments aging study of the two-step aging treatment, while plate sample P20 was selected for the baseline single step aging treatment. The four columns following the first column list the aging parameters including the first step temperature, the first step aging time, the second step temperature and the second step aging time for each plate sample. The plate samples are grouped by first step aging parameters. Always four plate samples, for example P01–P04, are in one group having the same first step aging parameters while the second step aging parameters were varied. The plate sample P17 represents the mid-range of the parameters of the two-step aging treatment. Following the aging parameters, the test results for the tensile properties are listed in columns 6 to 13 (from the left). The parameters ultimate strength (FTU) measured in units of ksi (kilo pounds—1,000 pounds, per square inch), yield strength (FTY) measured in units of ksi, elongation to rupture % e given in percent (%), and reduction of area % RA given in percent (%) were measured on each plate sample at room temperature and at cryogenic temperature (−320° F.), as shown in Table 1. The data obtained for the ultimate strength (FTU) were used for comparing the different aging cycles. Higher numbers represent a higher strength of the plate samples tested and therefore, a higher resistance to breaking under tension. The test results for the toughness at room temperature and cryogenic temperature (−320° F.) are listed in the last four columns of Table 1. The parameters $K_{JIC}$ and $K_{JQ}$ measured in units of ksi$\sqrt{}$in (kilo pounds per square inch times square root of inch) were determined according to ASTM E 1820. Higher numbers represent a higher toughness of the plate samples tested.

Referring now to Table 2, the tensile properties for the plate samples P01–P16 are shown grouped by second step aging parameters according to one embodiment of the present invention. For each group, the second step aging parameters including second step temperature and second step aging time were the same, while the first step parameters including first step temperature and first step aging time were varied. As can be seen in Table 2, varying the first step aging practice while maintaining a specific second step aging practice did not affect the resulting room temperature or cryogenic temperature (−320° F.) tensile properties, for example, the ultimate strength (FTU) and the yield strength (FTY). Accordingly, tensile properties and toughness properties of the aluminum-lithium alloy C458 primarily depend upon the second step aging practice.

Figure 2:
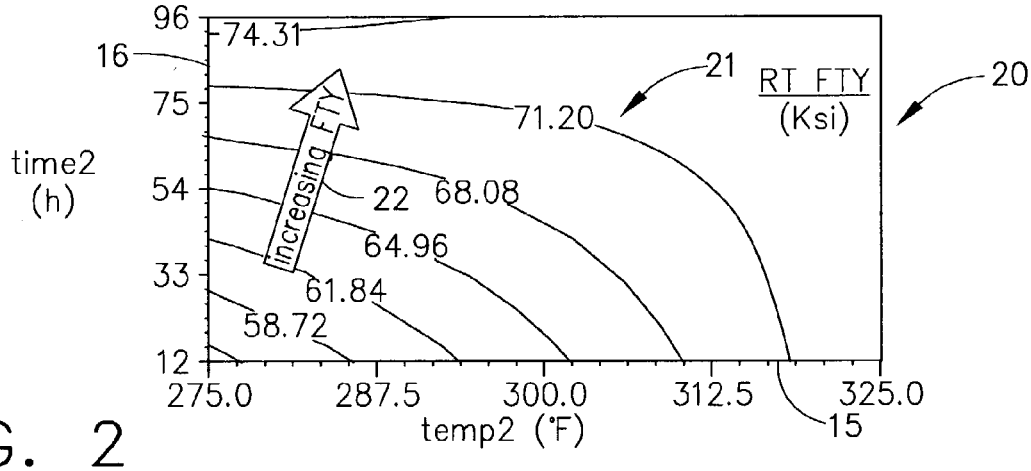
FIG. 2 is a contour plot illustrating the yield strength primarily dependent upon second step aging practice according to one embodiment of the present invention.
Figure 3:
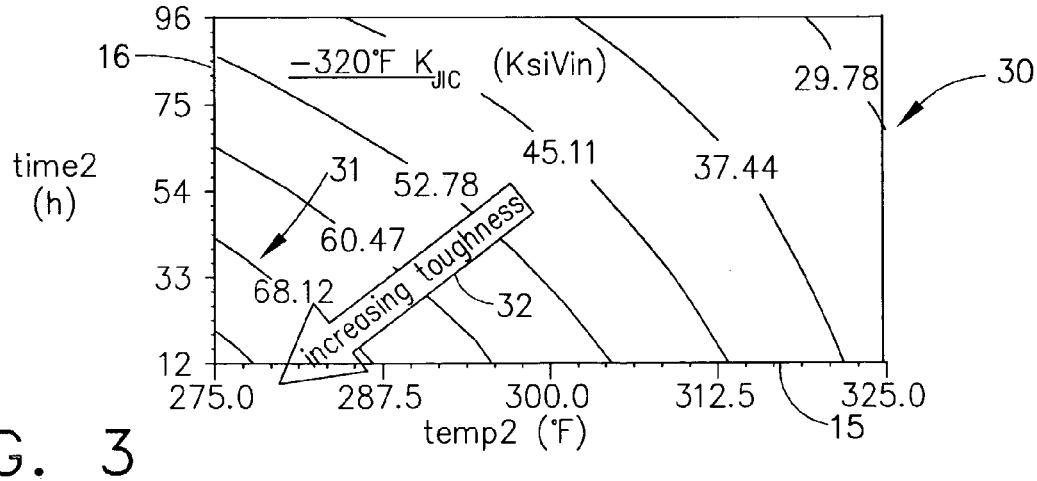
FIG. 3 is a contour plot illustrating the toughness primarily dependent upon second step aging practice according to one embodiment of the present invention.

Referring now to FIGS. 1, 2, and 3, contour plot 10 shows the ultimate strength (FIG. 1), contour plot 20 shows the yield strength (FIG. 2), and contour plot 30 shows the toughness (FIG. 3) primarily dependent upon the second step aging practice according to one embodiment of the present invention. FIGS. 1, 2, and 3 reflect the data listed in Table 1 and Table 2. FIG. 1 shows contour lines 11 of constant ultimate strength (FTU) at room temperature as a function of the second step aging temperature 15 (x-axis) measured in units of degree Fahrenheit (° F.) and the second step aging time 16 (y-axis) measured in units of hours (h). FIG. 2 shows contour lines 21 of constant yield strength (FTY) at room temperature as a function of the second step aging temperature 15 (x-axis) measured in units of degree Fahrenheit (° F.) and the second step aging time 16 (y-axis) measured in units of hours (h). As the second step aging temperature increases from 275° F. to 325° F., the alloy C458 appears to go from a peak-aged condition to an overaged condition. As indicated by arrow 12 in FIG. 1 and by arrow 22 in FIG. 2, the tensile properties (ultimate strength and yield strength) at room temperature increase with increased second step aging time and increase to a lesser extent with increased second step aging temperature. FIG. 3 shows contour lines 31 of toughness ($K_{JIC}$) at cryogenic temperature (−320° F.) as a function of the second step aging temperature 15 (x-axis) measured in units of degree Fahrenheit (° F.) and the second step aging time 16 (y-axis) measured in units of hours (h). As indicated by arrow 32, the toughness at cryogenic temperature increases with decreasing second step aging time and with decreasing second step aging temperature.

Figure 4:
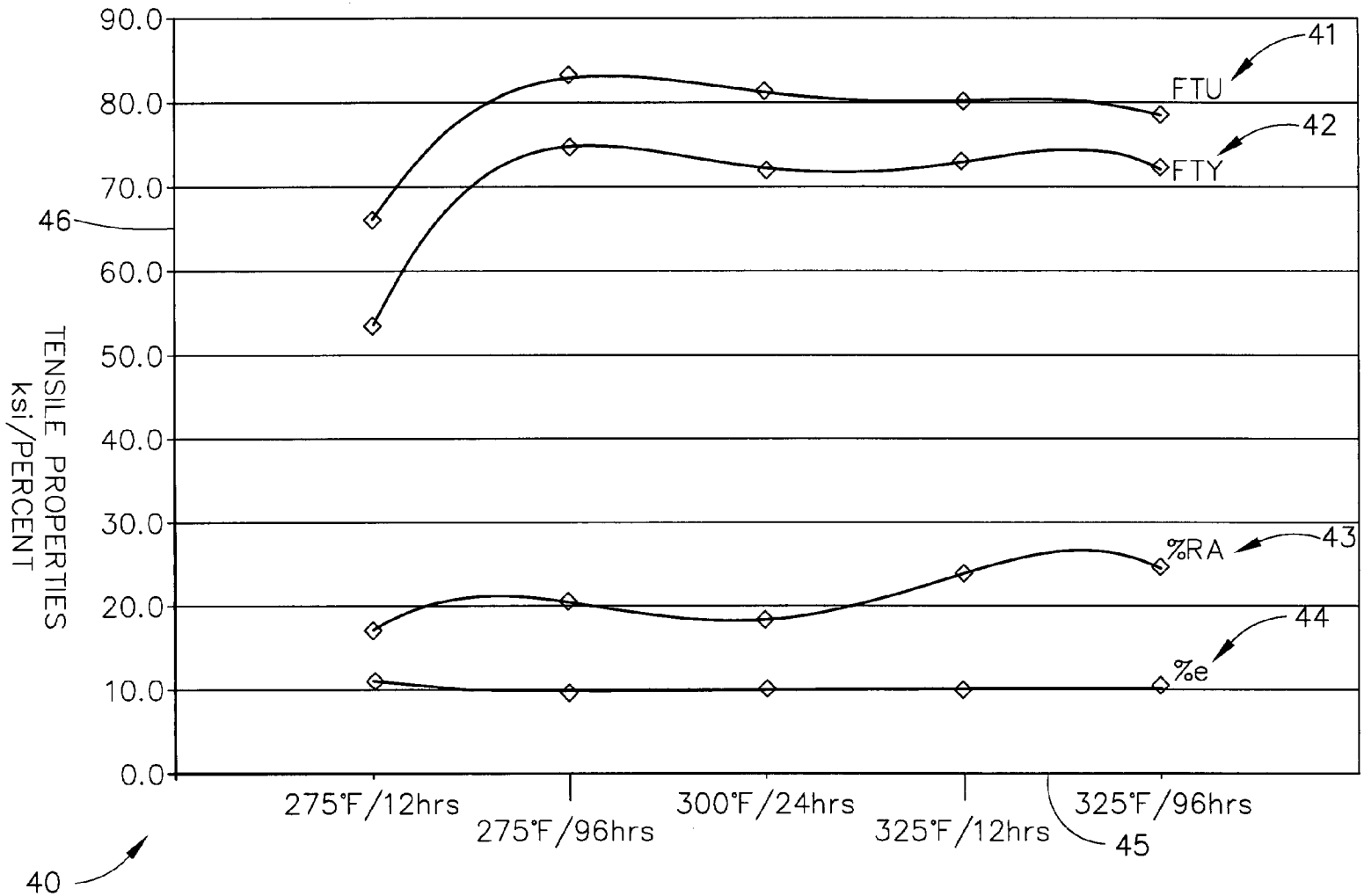
FIG. 4 is a graph illustrating tensile properties at room temperature dependent upon second step aging parameters according to one embodiment of the present invention.
Figure 5:
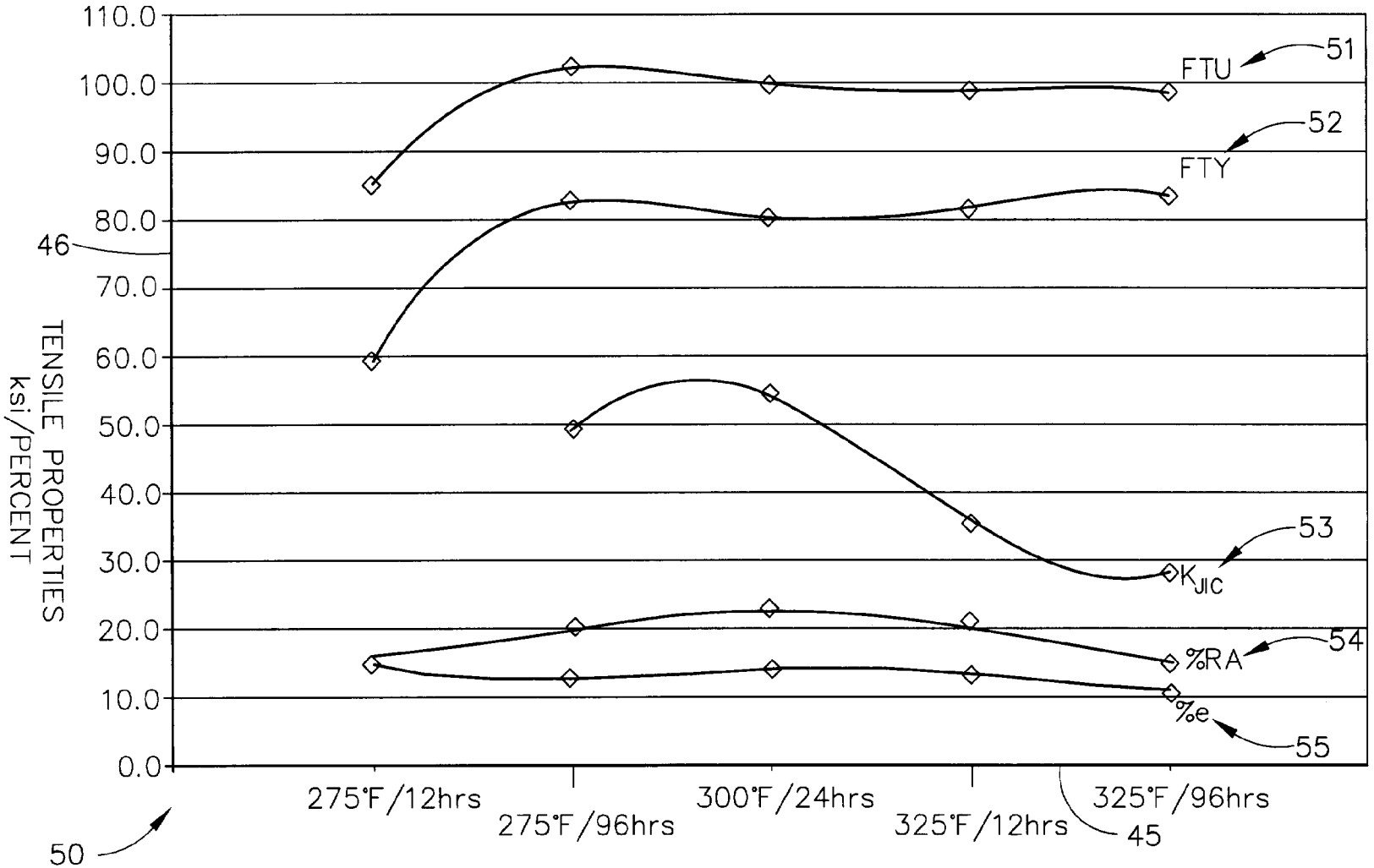
FIG. 5 is a graph illustrating tensile and toughness properties at cryogenic temperature (−320° F.) dependent upon second step aging parameters according to one embodiment of the present invention.

Referring now to FIGS. 4 and 5, graph 40 shown in FIG. 4 shows the tensile properties at room temperature dependent upon second step aging parameters and graph 50 shown in FIG. 5 shows the tensile and toughness properties at cryogenic temperature (−320° F.) dependent upon second step aging parameters according to one embodiment of the present invention. FIGS. 4 and 5 reflect the data listed in Table 1 and Table 2. Each data point in FIGS. 4 and 5 represents the average of all plate samples having the same second step aging parameters and all combinations of first step aging parameters as listed in Table 2.

Referring now to FIG. 4, the graph 40 comprises an x-axis 45 showing the second step aging parameters including aging temperature measured in units of degree Fahrenheit (° F.) and aging time measured in hours (h) and an y-axis 46 showing the tensile properties measured in units of kilo pounds—1,000 pounds, per square inch (ksi) and percent (%). The graph 40 includes trace 41 that shows the ultimate strength (FTU) at room temperature dependent upon the second step aging parameters, while trace 42 shows the yield strength (FTY) at room temperature dependent upon the second step aging parameters. Trace 41 and trace 42 both show the highest value for the second step aging parameters of 275° F. and 96 hours. The graph 40 further includes trace 43 that shows the elongation to rupture %e given in percent (%), and trace 44 that shows reduction of area % RA given in percent (%).

Referring now to FIG. 5, the graph 50 comprises an x-axis 45 showing the second step aging parameters including aging temperature measured in units of degree Fahrenheit (° F.) and aging time measured in hours (h) and an y-axis 46 showing the tensile properties measured in units of kilo pounds per square inch (ksi) and percent (%). The graph 50 includes trace 51 that shows the ultimate strength (FTU) at cryogenic temperature (−320° F.) dependent upon the second step aging parameters, while trace 52 shows the yield strength (FTY) at cryogenic temperature (−320° F.) dependent upon the second step aging parameters. Trace 51 and trace 52 both show the highest value for the second step aging parameters of 275° F. and 96 hours. Graph 50 further includes trace 53 that shows the toughness represented by parameter $K_{JIC}$ measured in units of ksi$\sqrt{\text{in}}$ at cryogenic temperature (−320° F.) dependent upon the second step aging parameters. The toughness is significantly higher for the second step aging parameters of 275° F./96 hours and 300° F./24 hours than for all other second step aging parameters. The graph 50 further includes trace 54 that shows the elongation to rupture % e given in percent (%), and trace 55 that shows reduction of area % RA given in percent (%).

Referring now to Table 3, the tensile and toughness properties of the plate samples P06, P17, and P20 are shown according to one embodiment of the present invention. To achieve T8 temper material properties, plate samples P06 and P17 both underwent a two-step aging treatment, while plate sample P20 underwent the prior art single-step aging treatment. As also shown in FIG. 5, the toughness at cryogenic temperature (−320° F.) is significantly improved with certain two-step aging practices (P06 and P17) when compared to the single-step aging practice (P20). The cryogenic toughness of plate samples P06 and P17 are the highest of all plate samples evaluated. A comparison of room temperature toughness and cryogenic toughness for P17 shows that the $K_{JQ}$ and $K_{JIC}$ values increased from 48.2 ksi-in$^{1/2}$ at room temperature to 54.1 ksi-in$^{1/2}$ at cryogenic temperature (−320° F.), as listed in Table 3. In contrast to the increased toughness at cryogenic temperature (−320° F.) of plate sample P17, the plate sample P20, which underwent the prior art single-step aging treatment, shows a drop in the cryogenic toughness. The $K_{JQ}$ and $K_{JIC}$ values for plate sample P20 decrease from 47.6 ksi-in$^{1/2}$ at room temperature to 41.6 ksi-in$^{1/2}$ at cryogenic temperature (−320° F.), as listed in Table 3. The highest ultimate strengths are obtained with a second step aging at 275° F. for 96 hours, which includes plate sample P06 that has a high cryogenic toughness. Sample plate P17 also has a high cryogenic toughness, but the ultimate strength at room temperature was only 81.2 ksi compared to the ultimate strength of 83.6 ksi for plate sample $PO_6$.

Therefore, it is possible to provide two options, among many more possibilities, for a two-step aging treatment applicable to aluminum-lithium alloy C458 in T3 condition to achieve T8 temper material properties. The first option, which provides the best combination of strength and toughness at cryogenic temperature, includes the first step aging at 175° F. for 192 hours followed by a second step aging at 275° F. for 96 hours. The second option, which includes more practical aging times and provides approximately 2 ksi lower room temperature ultimate/yield strength compared to the first option, includes the first step aging at 205° F. for 48 hours followed by a second step aging at 300° F. for 24 hours.

Figure 6:
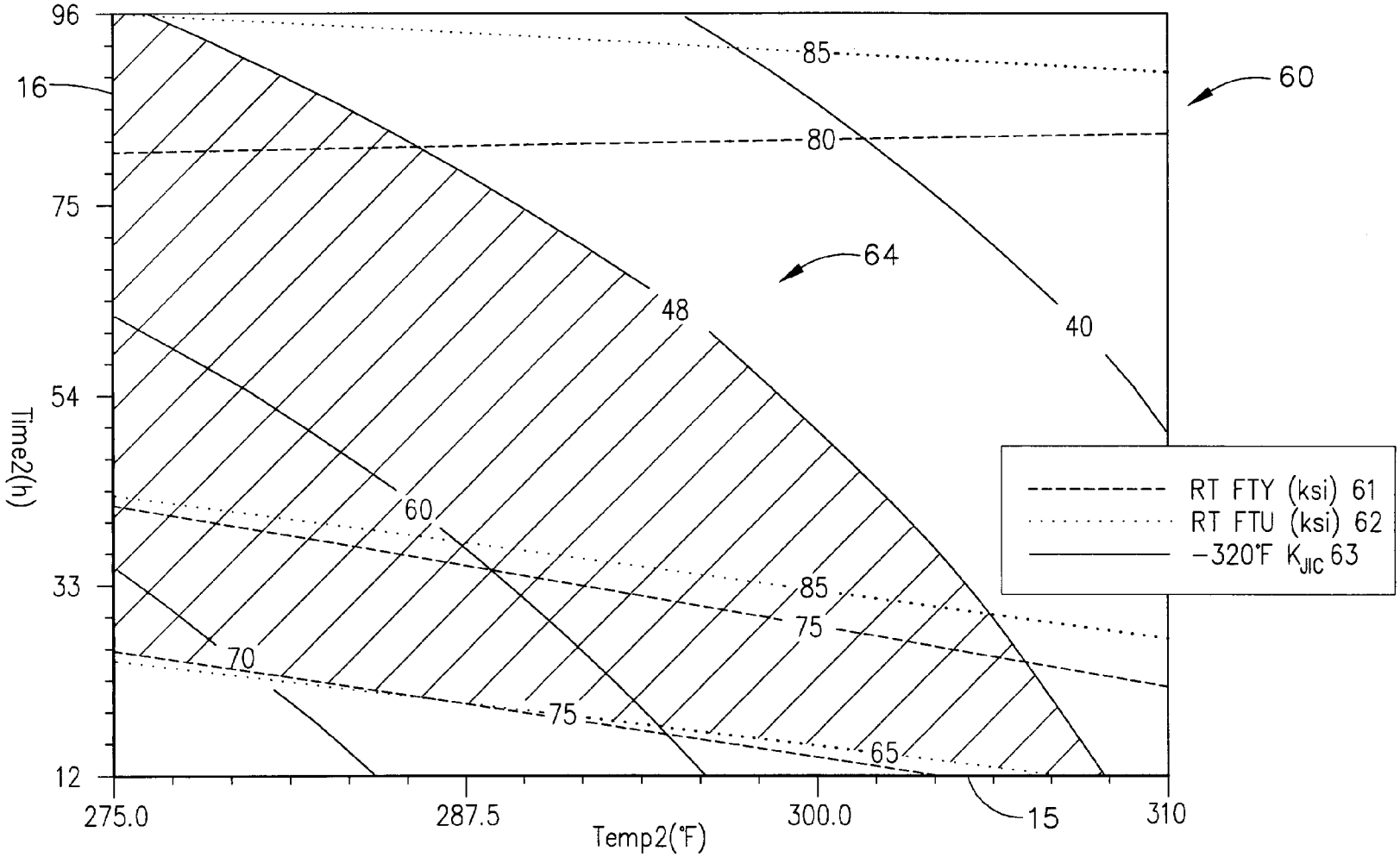
FIG. 6 is a contour plot illustrating the ultimate strength, the yield strength, and the toughness primarily dependent upon second step aging practice according to one embodiment of the present invention.

Referring now to FIG. 6, contour plot 60 shows the ultimate strength 62, the yield strength 61, and the toughness 63 primarily dependent upon the second step aging practice according to one embodiment of the present invention. FIG. 6 reflects the data listed in Table 1 and Table 2. FIG. 6 shows contour lines 62 of constant ultimate strength (FTU) at room temperature as a function of the second step aging temperature 15 (x-axis) measured in units of degree Fahrenheit (° F.) and the second step aging time 16 (y-axis) measured in units of hours (h). Further, FIG. 6 shows contour lines 61 of constant yield strength (FTY) at room temperature as a function of the second step aging temperature 15 (x-axis) measured in units of degree Fahrenheit (° F.) and the second step aging time 16 (y-axis) measured in units of hours (h). Still further, FIG. 6 shows contour lines 63 of toughness ($K_{JIC}$) at cryogenic temperature (−320° F.) as a function of the second step aging temperature 15 (x-axis) measured in units of degree Fahrenheit (° F.) and the second step aging time 16 (y-axis) measured in units of hours (h). For a first step aging treatment within a temperature range from about 175° F. to 250° F. and for a duration within a range from about 12 hours to 192 hours and a following second step aging treatment within a temperature range from about 275° F. to 310° F. and for a duration within a range from about 12 hours to 96 hours the material properties (the ultimate strength 62 at room temperature, the yield strength 61 at room temperature, and the toughness 63 at cryogenic temperature) are shown in the cross hatched area 64. The cross hatched area 64 provides a region of second step aging duration and temperature, which may provide a value of the cryogenic toughness equal to or greater than the toughness at room temperature at acceptable strength levels. Therefore, the present invention provides a contour plot 60 that makes it possible to select a first step aging treatment with in the specific range of 175° F. to 250° F./12 hours to 192 hours and to select the second step aging treatment within the specific range of 275° F. to 310° F./12 hours to 96 hours to obtain desired strength and toughness combinations, with the cryogenic toughness greater than the room temperature toughness.

Generally, compared to the second aging step of a two-step aging treatment, the first aging step of a two-step aging treatment features lower aging temperatures and longer aging times. This trend may be used to develop two-step aging treatments for aluminum-lithium alloys having a higher lithium content compared to alloy C458. Further, the experiments were conducted on aluminum-lithium alloy C458 material in plate form; still, the results may be applicable to aluminum-lithium alloy C458 material in sheet, extrusion, ring or other similar useful product forms.

It should be understood, of course, that the foregoing relates to preferred embodiments of the invention and that modifications may be made without departing from the spirit and scope of the invention as set forth in the following claims.

What is claimed is:

1. A method for an aging treatment for aluminum-lithium alloy C458, comprising the steps of:

providing an aluminum-lithium alloy C458 material, wherein said aluminum-lithium alloy C458 material is in T3 condition; and conducting a two-step aging treatment on said aluminum-lithium alloy C458 material, wherein T8 temper material properties and a toughness at cryogenic temperatures in the range of about 49 ksi$\sqrt{\text{in}}$ to about 54 ksi$\sqrt{\text{in}}$ compared to a toughness of about 48 ksi$\sqrt{\text{in}}$ at room temperature are provided, wherein said toughness at cryogenic temperatures is increased compared to said toughness at room temperature, and wherein said two-step aging treatment includes the steps of:

aging said aluminum-lithium alloy C458 material in a first step aging treatment within a temperature range of above 200° F. to about 250° F. for a duration within a range of about 12 hours to 192 hours; and aging said aluminum-lithium alloy C458 material in a second step aging treatment within a temperature range of about 275° F. to 310° F. for a duration within a range of about 12 hours to 96 hours.

2. The method for an aging treatment for aluminum-lithium alloy C458 of claim 1, wherein said aluminum-lithium alloy C458 material is nominally comprised of Al, 1.8 wt. % Li, 2.7 wt. % Cu, 0.3 wt. % Mg, 0.08 wt. % Zr, 0.3 wt. % Mn, and 0.6 wt. % Zn.

3. The method for an aging treatment for aluminum-lithium alloy C458 of claim 1, further comprising the step of providing said aluminum-lithium alloy C458 material in a product form selected from plate, sheet, extrusion, and ring.

4. The method for an aging treatment for aluminum-lithium alloy C458 of claim 1, further comprising the steps of applying a solution treatment to said aluminum-lithium alloy C458 material, quenching said aluminum-lithium alloy C458 material, and cold working said aluminum-lithium alloy C458 material to achieve said T3 condition of said aluminum-lithium alloy C458 material.

5. A method for an aging treatment for aluminum-lithium alloy C458, comprising the steps of:

providing an aluminum-lithium alloy C458 material, wherein said aluminum-lithium alloy C458 material is nominally comprised of Al, 1.8 wt. % Li, 2.7 wt. % Cu, 0.3 wt. % Mg, 0.08 wt. % Zr, 0.3 wt. % Mn, and 0.6 wt. % Zn, and wherein said aluminum-lithium alloy C458 material is in T3 condition; and conducting a two-step aging treatment on said aluminum-lithium alloy C458 material, wherein T8 temper material properties and a toughness at cryogenic temperatures of about 54 ksi$\sqrt{\text{in}}$ compared to a toughness of about 48 ksi$\sqrt{\text{in}}$ at room temperature are provided, wherein said toughness at cryogenic temperatures is increased compared to said toughness at room temperature, and wherein said two-step aging treatment includes the steps of:

aging said aluminum-lithium alloy C458 material in a first step aging treatment at a temperature of 205° F. for a duration of 48 hours; and aging said aluminum-lithium alloy C458 material in a second step aging treatment at a temperature of 300° F. for a duration of 24 hours.

6. The method for an aging treatment for aluminum-lithium alloy C458 of claim 5, further comprising the step of providing said aluminum-lithium alloy C458 material in plate form.

7. The method for an aging treatment for aluminum-lithium alloy C458 of claim 5, further comprising the step of providing said aluminum-lithium alloy C458 material in sheet form.

8. The method for an aging treatment for aluminum-lithium alloy C458 of claim 5, further comprising the step of providing said aluminum-lithium alloy C458 material in extrusion form.

9. The method for an aging treatment for aluminum-lithium alloy C458 of claim 5, further comprising the step of providing said aluminum-lithium alloy C458 material in ring form.

10. The method for an aging treatment for aluminum-lithium alloy C458 of claim 5, further comprising the steps of applying a solution treatment to said aluminum-lithium alloy C458 material, quenching said aluminum-lithium alloy C458 material, and cold working said aluminum-lithium alloy C458 material to achieve said T3 condition of said aluminum-lithium alloy C458 material.

11. The method for an aging treatment for aluminum-lithium alloy C458 of claim 5, further comprising the step of using said two-step aging treated aluminum-lithium alloy C458 material to manufacture launch vehicles for the aerospace industry.

12. A method for an aging treatment for aluminum-lithium alloy C458, comprising the steps of:

providing an aluminum-lithium alloy C458 material, wherein said aluminum-lithium alloy C458 material is nominally comprised of Al, 1.8 wt. % Li, 2.7 wt. % Cu, 0.3 wt. % Mg, 0.08 wt. % Zr, 0.3 wt. % Mn, and 0.6 wt. % Zn, and wherein said aluminum-lithium alloy C458 material is in T3 condition; and conducting a two-step aging treatment on said aluminum-lithium alloy C458 material, wherein T8 temper material properties and an increased toughness at cryogenic temperatures compared to room temperature are provided, and wherein said two-step aging treatment includes the steps of:

aging said aluminum-lithium alloy C458 material in a first step aging treatment at a temperature of 250° F. for a duration of 12 hours; and aging said aluminum-lithium alloy C458 material in a second step aging treatment at a temperature of 275° F. for a duration of 96 hours.

13. The method for an aging treatment for aluminum-lithium alloy C458 of claim 12, further comprising the steps of applying a solution treatment in air at a nominal temperature of 1020° F. for a nominal duration of 30 minutes to said aluminum-lithium alloy C458 material, quenching said aluminum-lithium alloy C458 material in water to room temperature, and cold working said aluminum-lithium alloy C458 material up to about 6% to achieve said T3 condition of said aluminum-lithium alloy C458 material.

14. The method for an aging treatment for aluminum-lithium alloy C458 of claim 12, wherein said step of cold working said aluminum-lithium alloy C458 material is done by stretching said aluminum-lithium alloy C458 material at room temperature within two hours of said quenching.

15. The method for an aging treatment for aluminum-lithium alloy C458 of claim 12, further comprising the step of providing said aluminum-lithium alloy C458 material in a product form selected from plate, sheet, extrusion, and ring.

16. The method for an aging treatment for aluminum-lithium alloy C458 of claim 12, further comprising the step of using said two-step aging treated aluminum-lithium alloy C458 to manufacture cryogenic tanks.

17. A method to increase the toughness of the aluminum-lithium alloy C458 at cryogenic temperatures compared to room temperature, comprising the steps of:

providing an aluminum-lithium alloy C458 material;

achieving T3 condition of said aluminum-lithium alloy C458 material by:

applying a solution treatment in air to said C458 material;

quenching said C458 material in water at room temperature; and cold working said C458 material at room temperature;

subjecting said C458 material to a first step aging treatment at a temperature of 250° F. for a duration of 12 hours; and subjecting said C458 material to a second step aging treatment at a temperature of 275° F. for a duration of 96 hours, wherein said first step aging treatment and said second step aging treatment of said C458 material provide T8 temper material properties and an increased toughness at cryogenic temperatures compared to room temperature.

18. The method to increase the toughness of the aluminum-lithium alloy C458 at cryogenic temperatures compared to room temperature of claim 17, further comprising the step of providing said aluminum-lithium alloy C458 material in a product form selected from plate, sheet, extrusion, and ring.

19. The method to increase the toughness of the aluminum-lithium alloy C458 at cryogenic temperatures compared to room temperature of claim 17, wherein said step of cold working is done by stretching said C458 material up to about 6% at room temperature, wherein the delay between said quenching and said stretching is less than 2 hours.

20. The method to increase the toughness of the aluminum-lithium alloy C458 at cryogenic temperatures compared to room temperature of claim 17, further comprising the step of using said two-step aging treated aluminum-lithium alloy C458 to manufacture cryogenic tanks used in launch vehicles for the aerospace industry.

21. A method to increase the toughness of the aluminum-lithium alloy C458 at cryogenic temperatures compared to room temperature, comprising the steps of:

providing an aluminum-lithium alloy C458 material;

achieving T3 condition of said aluminum-lithium alloy C458 material by:

applying a solution treatment in air to said C458 material;

quenching said C458 material in water at room temperature; and cold working said C458 material at room temperature;

subjecting said C458 material to a first step aging treatment at a temperature of 205° F. for a duration of 48 hours; and subjecting said C458 material to a second step aging treatment at a temperature of 300° F. for a duration of 24 hours, wherein said first step aging treatment and said second step aging treatment of said C458 material provide T8 temper material properties and a toughness at cryogenic temperatures of about 54 ksi$\sqrt{\text{in}}$ compared to a toughness of about 48 ksi$\sqrt{\text{in}}$ at room temperature, wherein said toughness at cryogenic temperatures is increased compared to said toughness at room temperature.

22. The method to increase the toughness of the aluminum-lithium alloy C458 at cryogenic temperatures compared to room temperature of claim 21, further comprising the step of providing said aluminum-lithium alloy C458 material in plate form.

23. The method to increase the toughness of the aluminum-lithium alloy C458 at cryogenic temperatures compared to room temperature of claim 21, further comprising the step of providing said aluminum-lithium alloy C458 material in sheet form.

24. The method to increase the toughness of the aluminum-lithium alloy C458 at cryogenic temperatures compared to room temperature of claim 21, further comprising the step of providing said aluminum-lithium alloy C458 material in extrusion form.

25. The method to increase the toughness of the aluminum-lithium alloy C458 at cryogenic temperatures compared to room temperature of claim 21, further comprising the step of providing said aluminum-lithium alloy C458 material in ring form.

26. The method to increase the toughness of the aluminum-lithium alloy C458 at cryogenic temperatures compared to room temperature of claim 21, further comprising the step of maintaining said aluminum-lithium alloy C458 material at room temperature for at least two days after said step of cold working said C458 material.

27. A method to increase the toughness of the aluminum-lithium alloy C458 at cryogenic temperatures compared to room temperature, comprising the steps of:

providing an aluminum-lithium alloy C458 material, wherein said aluminum-lithium alloy C458 material is comprised of Al, 1.8 wt. % Li, 2.7 wt. % Cu, 0.3 wt. % Mg, 0.08 wt. % Zr, 0.3 wt. % Mn, and 0.6 wt. % Zn, and wherein said aluminum-lithium alloy C458 material is provided in a product form selected from plate, sheet, extrusion, and ring;

achieving T3 condition of said aluminum-lithium alloy C458 material by:

applying a solution treatment in to said C458 material;

quenching said C458 material in water at room temperature; and stretching said C458 material 6% at room temperature, wherein the delay between said quenching and said stretching is less than 2 hours;

maintaining said C458 material at room temperature for at least two days;

subjecting said C458 material to a first step aging treatment at a temperature of 250° F. for a duration of 12 hours; and subjecting said C458 material to a second step aging treatment at a temperature of 275° F. for a duration of 96 hours, wherein said first step aging treatment and said second step aging treatment of said C458 material provide T8 temper material properties and an increased toughness at cryogenic temperatures compared to room temperature.

28. A method to increase the toughness of the aluminum-lithium alloy C458 at cryogenic temperatures compared to room temperature, comprising the steps of:

providing an aluminum-lithium alloy C458 material, wherein said aluminum-lithium alloy C458 material is comprised of Al, 1.8 wt. % Li, 2.7 wt. % Cu, 0.3 wt. % Mg, 0.08 wt. % Zr, 0.3 wt. % Mn, and 0.6 wt. % Zn; and wherein said aluminum-lithium alloy C458 material is provided in a product form selected from plate, sheet, extrusion, and ring;

achieving T3 condition of said aluminum-lithium alloy C458 material by:

applying a solution treatment in air to said C458 material;

quenching said C458 material in water at room temperature; and stretching said C458 material 6% at room temperature, wherein the delay between said quenching and said stretching is less than 2 hours;

maintaining said C458 material at room temperature for at least two days;

subjecting said C458 material to a first step aging treatment at a temperature of 205° F. for a duration of 48 hours; and subjecting said C458 material to a second step aging treatment at a temperature of 300° F. for a duration of 24 hours, wherein said first step aging treatment and said second step aging treatment of said C458 material provide T8 temper material properties and a toughness at cryogenic temperatures of about 54 ksi$\sqrt{\text{in}}$ compared to a toughness of about 48 ksi$\sqrt{\text{in}}$ at room temperature, wherein said toughness at cryogenic temperatures is increased compared to said toughness at room temperature.

* * * * *